US010801802B2

(12) United States Patent
Long et al.

(10) Patent No.: US 10,801,802 B2
(45) Date of Patent: Oct. 13, 2020

(54) BOW-MOUNTED QUIVER

(71) Applicants: Jeffrey S. Long, Wadley, AL (US); Danny Reel, Tampa, FL (US)

(72) Inventors: Jeffrey S. Long, Wadley, AL (US); Danny Reel, Tampa, FL (US)

( * ) Notice: Subject to any disclaimer, the term of this patent is extended or adjusted under 35 U.S.C. 154(b) by 0 days.

(21) Appl. No.: 16/599,088

(22) Filed: Oct. 10, 2019

(65) Prior Publication Data

US 2020/0141686 A1 May 7, 2020

Related U.S. Application Data

(60) Provisional application No. 62/743,928, filed on Oct. 10, 2018.

(51) Int. Cl.
*F41B 5/06* (2006.01)

(52) U.S. Cl.
CPC ..... *F41B 5/066* (2013.01)

(58) Field of Classification Search
CPC ..... F41B 5/06; F41B 5/066
See application file for complete search history.

(56) References Cited

U.S. PATENT DOCUMENTS

| | | | | |
|---|---|---|---|---|
| 2,464,068 | A | 3/1949 | Bear | |
| 2,801,625 | A | 8/1957 | Vose | |
| 3,286,961 | A * | 11/1966 | Mandolare | F41B 5/1453 248/518 |
| 4,247,027 | A | 1/1981 | Tardiff | |
| 4,363,312 | A | 12/1982 | Spitzke | |
| 4,522,187 | A | 6/1985 | Tafel | |
| 4,598,688 | A | 7/1986 | Paul et al. | |
| 4,621,606 | A | 11/1986 | Toth | |
| 4,805,584 | A | 2/1989 | Stinson | |
| 4,823,764 | A | 4/1989 | Knaack | |
| 5,107,819 | A | 4/1992 | Pugh | |
| 5,161,514 | A | 11/1992 | Cary | |
| 5,259,359 | A | 11/1993 | Meredith | |
| 6,892,717 | B1 | 5/2005 | Polanco et al. | |
| D527,787 | S | 9/2006 | Rager | |

(Continued)

FOREIGN PATENT DOCUMENTS

RU 2365849 C1 8/2009

OTHER PUBLICATIONS

Fin-Finder Arrow-Lock Quiver; printed from https://www.fin-finder.com/product/arrow-lock-quiver on Aug. 28, 2019.

*Primary Examiner* — John A Ricci
(74) *Attorney, Agent, or Firm* — Nath, Goldberg & Meyer; Richard C. Litman

(57) ABSTRACT

The bow-mounted quiver is a removable attachment for a conventional archery bow. The bow-mounted quiver includes a mounting plate adapted for releasable mounting on the archery bow, an arm, and a U-shaped retaining member. The arm has first and second arm portions. A first end of the first arm portion is pivotally attached to the mounting plate, and a second end of the first arm portion is pivotally attached to a first end of the second arm portion. The second arm portion may have an adjustable length. The U-shaped retaining member has a central portion and a pair of free ends. The central portion is pivotally attached to a second end of the second arm portion, and each of the free ends defines a recess for releasably retaining a shaft of an arrow.

17 Claims, 3 Drawing Sheets

(56) References Cited

U.S. PATENT DOCUMENTS

| | | | | |
|---|---|---|---|---|
| 7,275,528 | B1 | 10/2007 | Daigler | |
| 7,607,626 | B2 | 10/2009 | Whitmire | |
| 2003/0062034 | A1 | 4/2003 | Proctor | |
| 2012/0125307 | A1* | 5/2012 | Bromley | F41B 5/066 124/88 |
| 2016/0334183 | A1 | 11/2016 | Evans | |

* cited by examiner

BOW-MOUNTED QUIVER

CROSS-REFERENCE TO RELATED APPLICATION

This application claims the benefit of U.S. Provisional Patent Application No. 62/743,928, filed on Oct. 10, 2018.

BACKGROUND

1. Field

The disclosure of the present patent application relates to archery, and particularly to a bow-mounted quiver for releasably holding arrows and which is mounted to the bow.

2. Description of the Related Art

In archery, one of the greatest impediments to rapid shooting is the inaccessibility of successive arrows. Conventionally, arrows are held in a quiver, which may be slung over the shoulder of the archer or may rest at the archer's side. Using such conventional quivers for obtaining the next arrow to be shot presents problems for the archer, particularly when rapid shooting is desired. Using a conventional quiver, the archer is not only required to reach his or her hand back or to the side, but also to turn his or her head, thus causing a momentary distraction for the archer, deflecting his or her attention from the target. If the target is a moving target, such as a swiftly moving animal, this distraction may make the archer's next shot impossible.

Although quivers adapted for mounting on bows are known, such quivers are often mounted to the bow with an orientation which is awkward for the archer to reach. Additionally, such quivers may impede the archer's view and/or be cumbersome when the archer is transporting the bow. Thus, a bow-mounted quiver solving the aforementioned problems is desired.

SUMMARY

The bow-mounted quiver is a removable attachment for a conventional archery bow. The bow-mounted quiver includes a mounting plate, adapted for releasable mounting on the archery bow, an arm and a U-shaped retaining member. The arm has first and second arm portions. A first end of the first arm portion is pivotally secured to the mounting plate, and a second end of the first arm portion is pivotally secured to a first end of the second arm portion. The second arm portion may have an adjustable length. The U-shaped retaining member has a central portion and a pair of free ends. The central portion is pivotally secured to a second end of the second arm portion, and each of the free ends defines a recess for releasably retaining a shaft of an arrow.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
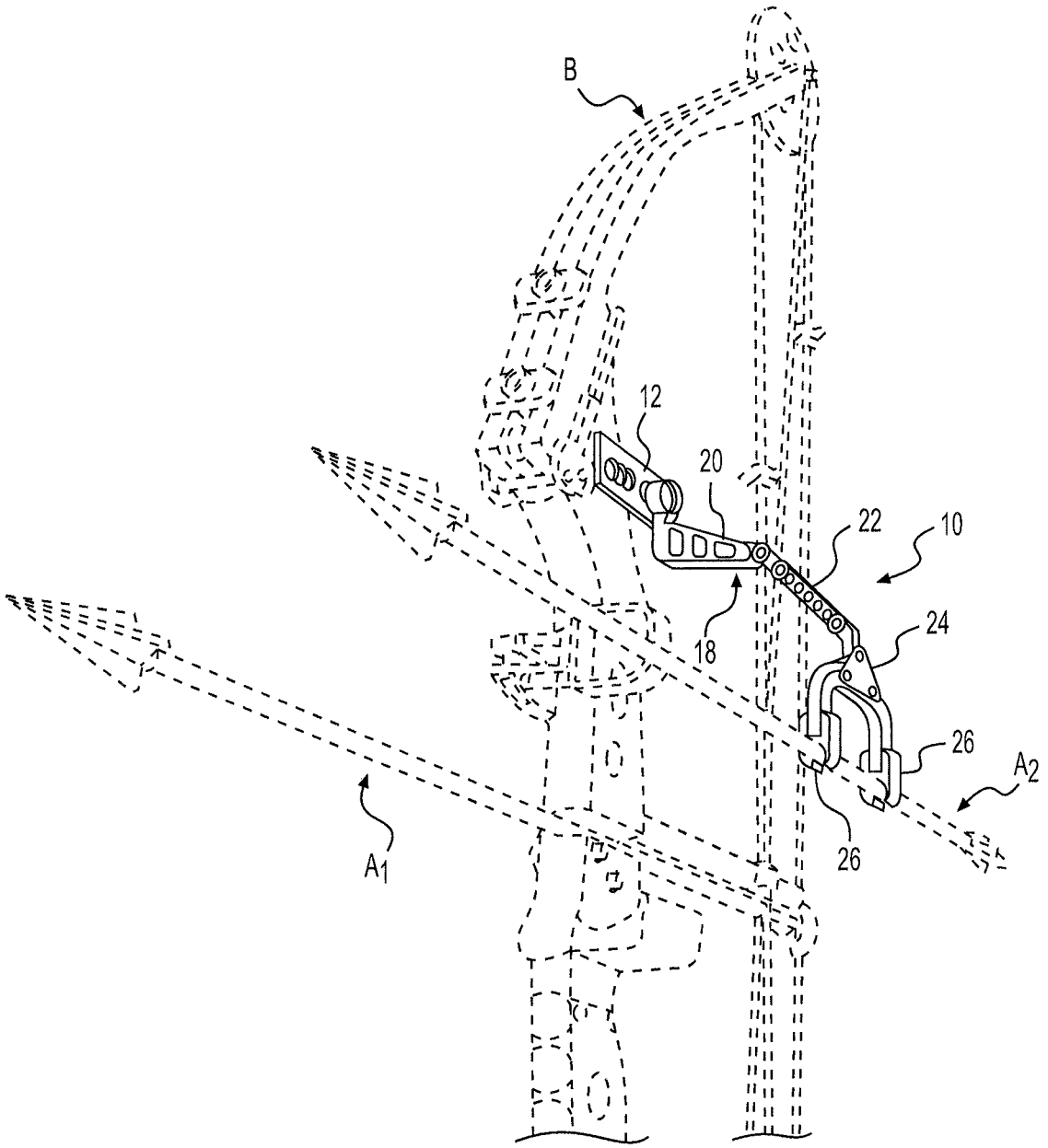
FIG. 1 is an environmental, perspective view of a bow-mounted quiver.
Figure 2:
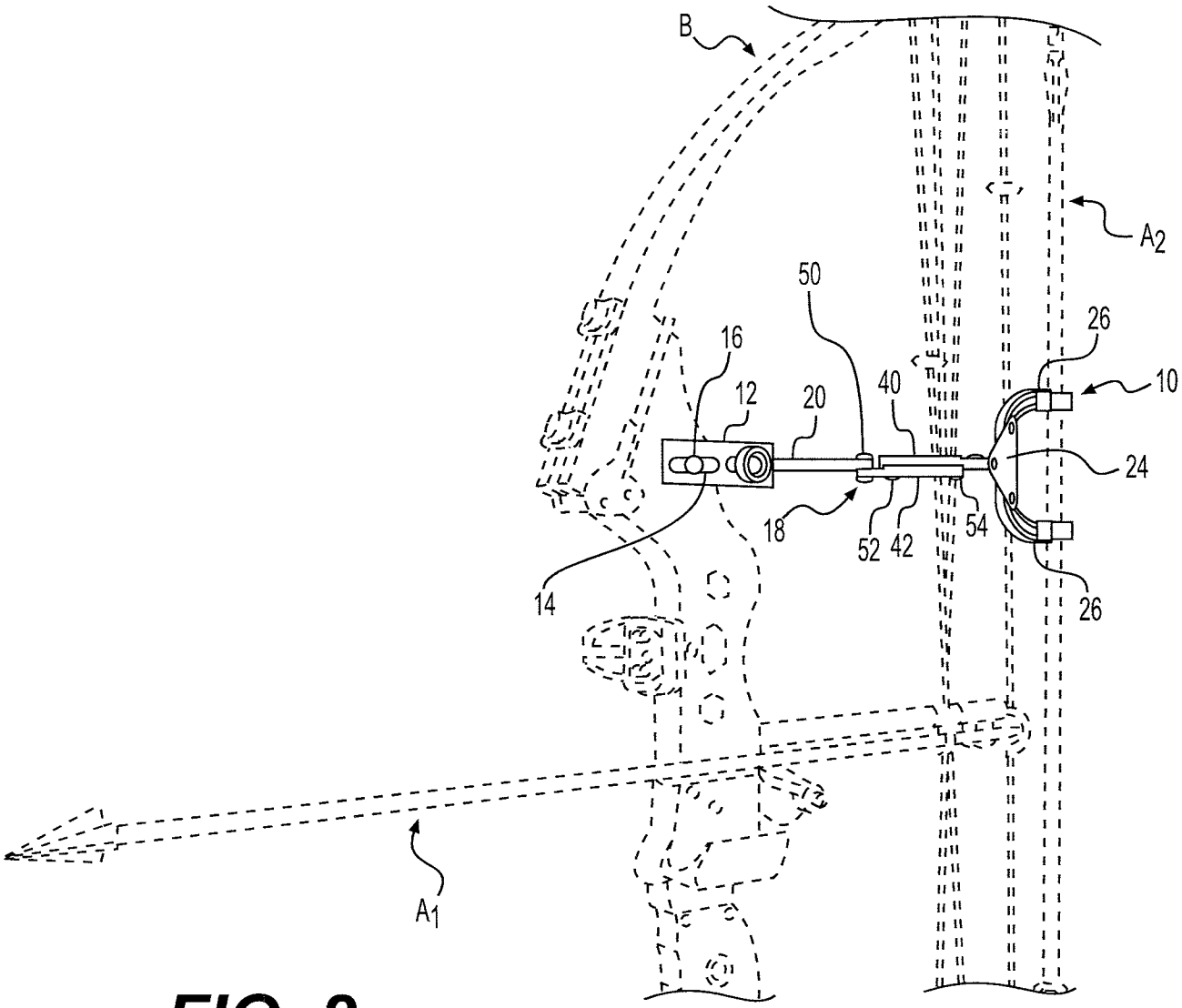
FIG. 2 is an environmental, perspective view of the bow-mounted quiver.
Figure 3:
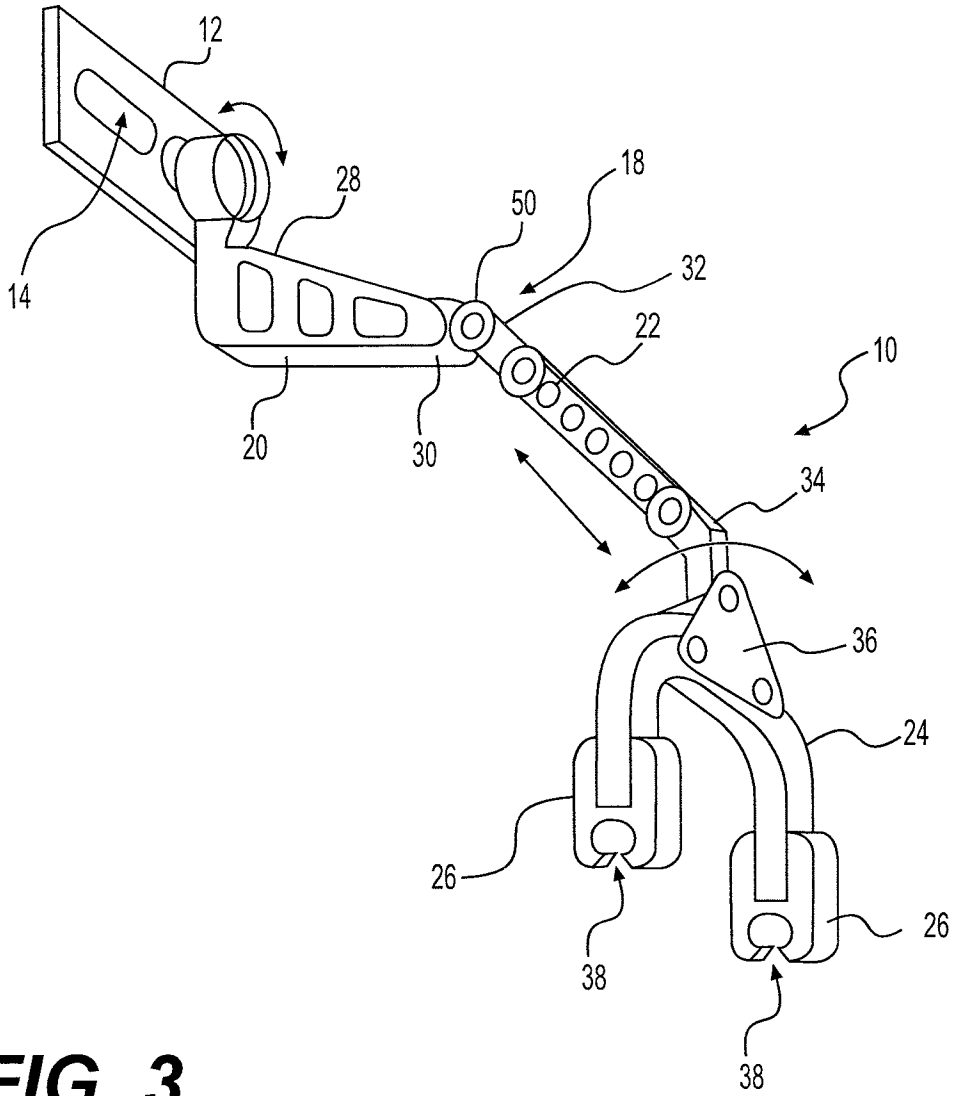
FIG. 3 is a perspective view of the bow-mounted quiver.

Referring now to FIGS. 1-3, the bow-mounted quiver 10 is a removable attachment for a conventional archery bow, such as exemplary bow B with a quiver that holds a first arrow $A_1$ in a conventional manner. Once the bow-mounted quiver 10 is attached to the bow B as shown, a second arrow $A_2$ can also be supported by the bow B. It should be understood that bow B, and associated arrows $A_1$ and $A_2$, are shown in FIGS. 1 and 2 for exemplary purposes only. As best shown in FIG. 2, the bow-mounted quiver 10 includes a mounting plate 12 for releasable mounting on the archery bow B. In the non-limiting example shown in FIG. 2, mounting plate 12 has a slot 14 formed therethrough, allowing the mounting plate 12 to be releasably secured to bow B through removable reception of bolt 16. However, it should be understood that mounting plate 12 may be releasably secured to bow B by any suitable type of releasable attachment. Further, it should be understood that the overall shape, contouring and relative dimensions of mounting plate 12 are shown in FIGS. 1-3 for exemplary purposes only, and may be varied dependent upon the particular type of bow being used.

The bow-mounted quiver 10 further includes arm 18, which has first and second arm portions 20, 22, respectively. As best seen in FIG. 3, first end 28 of the first arm portion 20 is pivotally secured to the mounting plate 12. In the non-limiting example of FIGS. 1-3, first end 28 is shown being pivotally connected to mounting plate 12 by a pivoting knob with a spring-mounted pin, however, it should be understood that any suitable type of pivotal attachment may be utilized.

A second end 30 of the first arm portion 20 is pivotally secured to a first end 32 of the second arm portion 22. In FIGS. 2 and 3, a conventional pivot pin 50 is shown, however, it should be understood that any suitable type of pivotal attachment may be utilized for pivotally attaching second end 30 to first end 32. The second arm portion 22 may have an adjustable length. As best shown in FIG. 2, as a non-limiting example, second arm portion 22 may include a pair of elongated members 40, 42, releasably secured to one another by a pair of bolts 52, 54. By removing the bolts 52, 54, the pair of elongated members 40, 42 are free to slide with respect to one another, allowing the user to adjust the length of second arm portion 22. Each of elongated members 40, 42 has a plurality of apertures formed therethrough, as shown, for removably receiving bolts 52, 54 to selectively lock elongated members 40, 42 at a desired position with respect to one another. It should be understood that the pair of elongated members 40, 42 are shown for exemplary purposes only, and that any length-adjustable member, such as a telescoping rod or the like, may also be used to define second arm portion 22.

A U-shaped retaining member 24 is further provided. As best seen in FIG. 3, the U-shaped retaining member 24 has a central portion 36 and a pair of free ends 26. The central portion 36 is pivotally secured to a second end 34 of the second arm portion 22, and each of the free ends 26 defines a recess 38 for releasably retaining a shaft of an arrow.

The pivotal securement of first end 28 of first arm portion 20 to mounting plate 12, along with the pivotal attachment of second end 30 of first arm portion 20 to first end 32 of second arm portion 22, the length adjustment of second arm portion 22, and the pivotal connection of central portion 36 of U-shaped retaining member 24 to second end 34 of second arm portion 22 allows the user to easily selectively position the arrow $A_2$ held by U-shaped retaining member 24. With four degrees of freedom for adjustment, the user is able to easily choose an orientation for the bow-mounted quiver 10 which is easiest for retrieval of the arrow, and which allows the user a clear line of sight. For example, FIG. 1 shows the bow-mounted quiver 10 in a folded position such that the second arrow $A_2$ extends perpendicular to the first arrow $A_1$ that is held in the conventional quiver. Such a position can facilitate carrying the second arrow $A_2$ when the second arrow $A_2$ is not immediately needed. FIG. 2 shows the bow-mounted quiver 10 in an extended position such that the second arrow $A_2$ extends parallel to the first arrow $A_1$, and is ready for immediate use.

It is to be understood that the bow-mounted quiver is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A bow-mounted quiver, comprising:

a mounting plate adapted for releasable mounting on an archery bow;

an arm having a first arm portion and a second arm portion, the first arm portion having a first end pivotally attached to the mounting plate and a second end pivotally attached to the second arm portion; and a U-shaped retaining member having a central portion and a pair of free ends, the central portion being pivotally attached to the second arm portion, each of the free ends having a recess formed therein adapted for releasably retaining a shaft of an arrow.

2. The bow-mounted quiver as recited in claim 1, wherein the mounting plate has a slot formed therein, the slot being adapted for releasably receiving a retaining member.

3. The bow-mounted quiver as recited in claim 1, wherein the second arm portion has an adjustable length.

4. The bow-mounted quiver as recited in claim 3, wherein the second arm portion comprises a pair of elongated members, the elongated members being selectively and adjustably slidable with respect to one another.

5. The bow-mounted quiver as recited in claim 4, wherein each of the second arm portion elongated members has a plurality of apertures formed therein.

6. The bow-mounted quiver as recited in claim 5, further comprising at least one locking member removably received by one of the apertures in each said second arm portion elongated member to releasably lock the pair of elongated members of said second arm portion with respect to one another.

7. A bow-mounted quiver, comprising:

a mounting plate adapted for releasable mounting on an archery bow;

an arm having a first arm portion and a second arm portion, the first arm portion having a first end pivotally attached to the mounting plate and a second end pivotally attached to the second arm portion, the second arm portion having an adjustable length; and a U-shaped retaining member having a central portion and a pair of free ends, the central portion being pivotally attached to the second arm portion, each of the free ends having a recess formed therein adapted for releasably retaining a shaft of an arrow.

8. The bow-mounted quiver as recited in claim 7, wherein the mounting plate has a slot formed therein, the slot being adapted for releasably receiving a retaining member.

9. The bow-mounted quiver as recited in claim 7, wherein the second arm portion comprises a pair of elongated members, the elongated members being selectively and adjustably slidable with respect to one another.

10. The bow-mounted quiver as recited in claim 9, wherein each of the second arm portion elongated members has a plurality of apertures formed therein.

11. The bow-mounted quiver as recited in claim 10, further comprising at least one locking member removably received by one of the apertures in each said second arm portion elongated member to releasably lock said pair of elongated members of said second arm portion with respect to one another.

12. An archery bow and bow-mounted quiver, comprising:

an archery bow;

a mounting plate adapted for releasable mounting on the archery bow;

an arm having a first arm portion and a second arm portion, the first arm portion having a first end pivotally attached to the mounting plate and a second end pivotally attached to the second arm portion; and a U-shaped retaining member having a central portion and a pair of free ends, the central portion being pivotally attached to the second arm portion, wherein each of the free ends has a recess formed therein adapted for releasably retaining a shaft of an arrow.

13. The archery bow and bow-mounted quiver as recited in claim 12, wherein the mounting plate has a slot formed therein, the slot being adapted for releasably receiving a retaining member.

14. The archery bow and bow-mounted quiver as recited in claim 12, wherein the second arm portion has an adjustable length.

15. The archery bow and bow-mounted quiver as recited in claim 14, wherein the second arm portion comprises a pair of elongated members, the elongated members being selectively and adjustably slidable with respect to one another.

16. The archery bow and bow-mounted quiver as recited in claim 15, wherein each of the second arm portion elongated members has a plurality of apertures formed therein.

17. The archery bow and bow-mounted quiver as recited in claim 16, further comprising at least one locking member removably received by one of the apertures of each said second arm portion elongated member to releasably lock the pair of second arm portion elongated members with respect to one another.

* * * * *